US008091156B1

(12) United States Patent
Lordahl

(10) Patent No.: US 8,091,156 B1
(45) Date of Patent: Jan. 10, 2012

(54) UNIVERSAL WALL MOUNT TOILET GASKET

(76) Inventor: Var E. Lordahl, Long Grove, IL (US)

( * ) Notice: Subject to any disclaimer, the term of this patent is extended or adjusted under 35 U.S.C. 154(b) by 1160 days.

(21) Appl. No.: 11/899,525

(22) Filed: Sep. 6, 2007

Related U.S. Application Data

(63) Continuation-in-part of application No. 11/097,559, filed on Apr. 2, 2005, now abandoned.

(51) Int. Cl.

| | |
|---|---|
| ***E03D 11/17*** | (2006.01) |
| ***E03D 11/16*** | (2006.01) |
| ***E03D 11/14*** | (2006.01) |
| ***E03D 11/00*** | (2006.01) |

(52) U.S. Cl. ..... 4/252.6; 4/252.3; 4/252.4; 285/56

(58) Field of Classification Search ..... 4/252.1–252.6; 277/586; 285/56
See application file for complete search history.

(56) References Cited

U.S. PATENT DOCUMENTS

| | | | | |
|---|---|---|---|---|
| 1,699,983 | A * | 1/1929 | Miller | 4/252.6 |
| 2,152,719 | A * | 4/1939 | Williams | 4/252.6 |
| 6,644,670 | B2 * | 11/2003 | Etcheverry | 277/606 |
| 2004/0133969 | A1 * | 7/2004 | Akin | 4/252.2 |

* cited by examiner

*Primary Examiner* — Dinh Nguyen
*Assistant Examiner* — Chee-Chong Lee
(74) *Attorney, Agent, or Firm* — Kajane McManus

(57) ABSTRACT

The universal wall mount toilet gasket has a planar configuration and has at least one opening therein for engagement about a drain, the gasket being maintained in position by a base of the toilet engaged thereover.

1 Claim, 1 Drawing Sheet

UNIVERSAL WALL MOUNT TOILET GASKET

CROSS REFERENCE TO RELATED APPLICATIONS

This application is a continuation-in-part of U.S. application Ser. No. 11/097,559 filed Apr. 2, 2005 and entitled Universal Toilet Gasket, now abandoned.

BACKGROUND OF THE INVENTION

1. Field of the Invention

The present invention pertains to a universal gasket which seals between a wall mount toilet base and a drain therefor.

More particularly, the gasket creates a total seal between the toilet base and the toilet supporting structure, or wall, even if the supporting structure has an irregular surface finish or tile grout lines, while it simultaneously stabilizes against rocking and at the same time protects both the toilet and the support structure from chipping or breaking during initial toilet installation.

Further, in commercial situations, as an example, the universal wall gasket keeps building structures, such as ceilings and walls, below a toilet, from being damaged by leakage of fluid around a wall mount toilet thereabove, such as that caused by pressure cleaning of bathroom walls, etc.

2. Prior Art

Heretofore, the only device that has been used to seal a toilet to a wall has been the primary toilet seal, which is located between the toilet and the sewage system, which has typically been a thick waxring. Heretofore, when sealing of a toilet has been required, it has been accomplished using some form of caulk or grout, which often is unsightly after being installed and is not durable in situations such as pressure washing.

In summary, this universal gasket, which stabilizes against wobbling and seals simultaneously, as described above, is not only novel, but also it is timely in light of the popularity and diversity of the various tiles and other sealing surfaces which now are being shipped worldwide, many of which have an inconsistent thickness, creating a special need for this gasket.

As will be described hereinafter, none previously proposed have been 100% sealing, have been universal, for stabilization or useable on a wall.

SUMMARY OF THE INVENTION

According to the invention there is provided a universal toilet gasket having a planar configuration and having at least one opening therein for engagement about a drain, and a plurality of throughbores for engagement over bolts of any hanger configuration, the gasket being maintained in position by a wall mount toilet engaged thereover.

DESCRIPTION OF THE PREFERRED EMBODIMENTS

Figure 1:
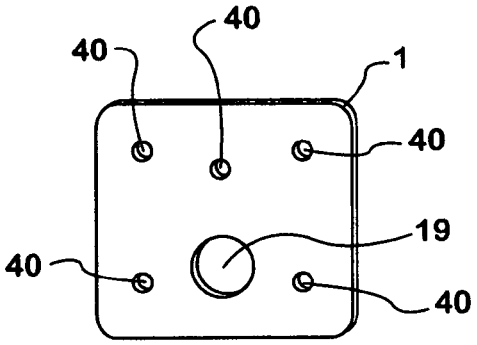
FIG. 1 is a perspective view of a wall gasket of the present invention.

Referring now to the drawings in greater detail there is illustrated therein the universal wall mount toilet gasket made in accordance with the teachings of the present invention and generally identified by the reference numeral 1.

As shown, the gasket 1 is planar in configuration for engagement between a toilet base 2 and an outlet drain 4 therefor in a wall 6.

Turning now to the gasket 1 for use with wall 6 mounted toilet bases 2 the material thereof is preferably a durable, pliable, resilient, water proof material which is trimmable, as may be required.

The toilet base 2 is small so the gasket 1 is created in a square planer configuration, though this should not be construed as limiting. Further, a wall mount base 2 is typically provided with one of a plurality of three bolt 31 or four bolt 31 mounting configurations, and the gasket 1 is provided with a plurality of throughbores 40 oriented to accommodate substantially all such mounting configurations.

The wall mount gasket 1 must also include the opening 19 therein for accommodating the drain 4.

In a preferred embodiment, a plurality of breakaway tabs or washers 42 are provided about a periphery of the opening 19 which are used to secure the gasket 1 to internal structures, i.e., a hanger 21, of the wall 6, to hold the gasket 1 in position until the toilet base 2 is securely mounted thereover, though this should not be construed as limiting. These tabs 42 are trimmable and are also useful in providing exact alignment of the gasket 1 if such is desired. In this respect, the trimmable tabs 42 are first installed onto the blots 31 of the hanger 20 and then the gasket 1 is aligned thereover, allowing for precise positioning.

Figure 2:
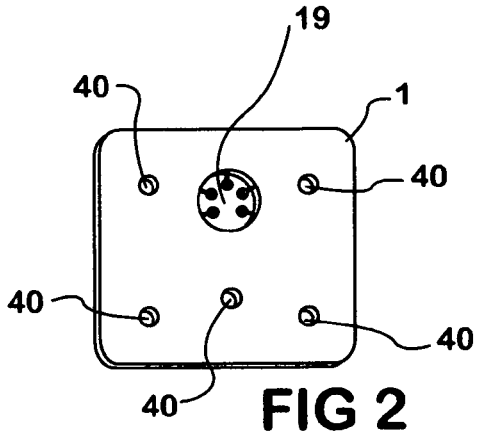
FIG. 2 is a perspective view of the wall gasket of FIG. 1 and shows same incorporating mounting tabs or washers.
Figure 3:
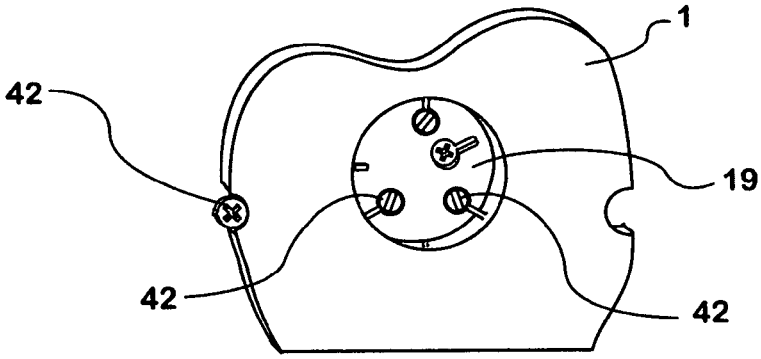
FIG. 3 is an enlarged view of the mounting tabs.
Figure 4:
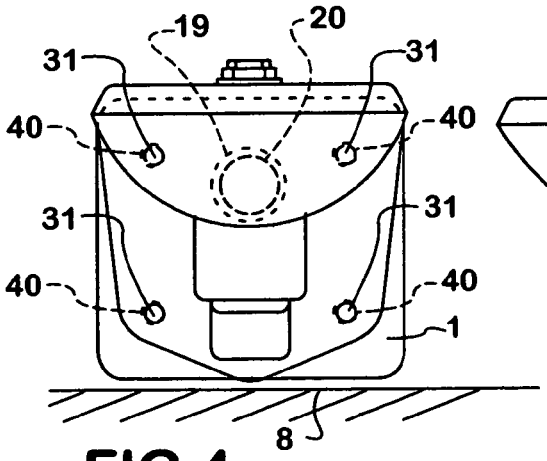
FIG. 4 is a front view of a wall mount toilet showing the gasket used in mounting thereof.
Figure 5:
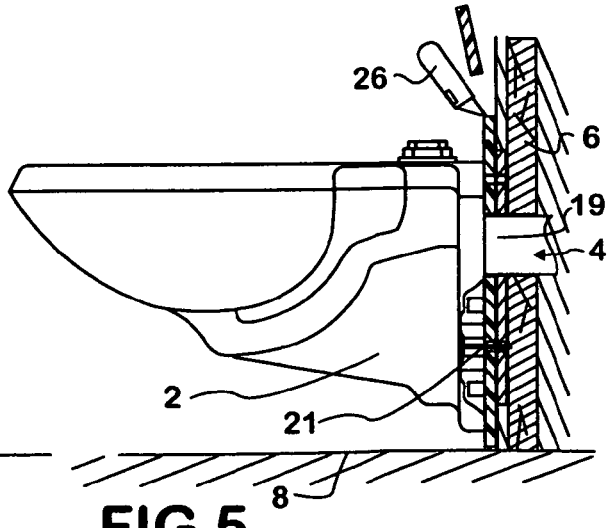
FIG. 5 shows the gasket of FIG. 4 to be trimmable, and shows same mounted over a hanger therefor.

In this wall mount gasket 1, it has been found preferable to provide the opening 19 in an off center position, with the orientation of the gasket 1 being reversible, as shown in FIGS. 1 and 2 to accommodate three hole (FIG. 2) or four hole (FIG. 1) mounting while accommodating for drain 4.

As described above, the wall gasket 1 of the present invention, provides a number of advantages, some of which have been described above and others of which are inherent in the invention. Also, modifications to the wall gasket 1 can be proposed without departing from the teachings herein. Accordingly, the scope of the invention is only to be limited as necessitated by the accompanying claims.

The invention claimed is:

1. A universal wall mount toilet gasket consisting of a substantially square gasket having a planar configuration, being made of a firm yet trimmable water proof material, and having at least one opening therein for engagement about a drain, a periphery of the opening including a plurality of breakaway tabs for engaging the gasket to a hanger, and at least five throughbores for engagement over bolts of a wall mount toilet base of any configuration, the gasket being maintained in position by the base of the toilet engaged thereover and to a wall therebehind, and the gasket having an off center drain engaging opening therein.

* * * * *